US007104677B2

(12) United States Patent
Barlian et al.

(10) Patent No.: US 7,104,677 B2
(45) Date of Patent: Sep. 12, 2006

(54) INDICATING LIGHT

(75) Inventors: Reinhold Barlian, Bad Mergentheim (DE); Karl-Heinz Lux, Weikersheim (DE)

(73) Assignee: Bartec Componenten und Systeme GmbH, Bad Mergentheim (DE)

( * ) Notice: Subject to any disclaimer, the term of this patent is extended or adjusted under 35 U.S.C. 154(b) by 25 days.

(21) Appl. No.: 10/387,817

(22) Filed: Mar. 13, 2003

(65) Prior Publication Data

US 2003/0214816 A1 Nov. 20, 2003

(30) Foreign Application Priority Data

Mar. 13, 2002 (DE) ..... 102 10 984

(51) Int. Cl.
*F21S 8/10* (2006.01)
*F21V 21/00* (2006.01)

(52) U.S. Cl. ..... 362/545; 362/270; 362/186; 200/313; 200/314

(58) Field of Classification Search ..... 362/548, 362/311, 376, 326, 800, 270, 277, 280, 338, 362/363, 545, 555, 186, 340; 200/313, 314, 200/317, 315, 312, 310
See application file for complete search history.

(56) References Cited

U.S. PATENT DOCUMENTS 3,927,290 A * 12/1975 Denley ..... 200/314
5,252,798 A * 10/1993 Kamada ..... 200/314
5,391,848 A * 2/1995 Murphy ..... 200/314
5,878,870 A * 3/1999 Ohtaki ..... 200/314

* cited by examiner

*Primary Examiner*—John Anthony Ward
(74) *Attorney, Agent, or Firm*—Horst M. Kasper

(57) ABSTRACT

Indicating light for an optical display, with a housing exhibiting electrically conductive parts, a light-emitting diode, and a push element, capable of axial displacement in a hollow rod, for a switch mounted in the hollow rod.

62 Claims, 3 Drawing Sheets

INDICATING LIGHT

The invention relates to a indicating light for an optical display.

Known indicating lights exhibit a housing, a light display, and an electrical switch mechanism, which is arranged offset laterally in the housing or located externally on the housing, and is capable of actuation by axial displacement of the light display.

The problem of the invention consists of providing a indicating light which is capable of being manufactured with simple means as a compact structural unit, and has a high level of functional reliability.

This problem is resolved according to the invention by the features of claim 1.

Preferred embodiments and further embodiments of the invention are characterised by the features of the sub-claims.

Figure 1:
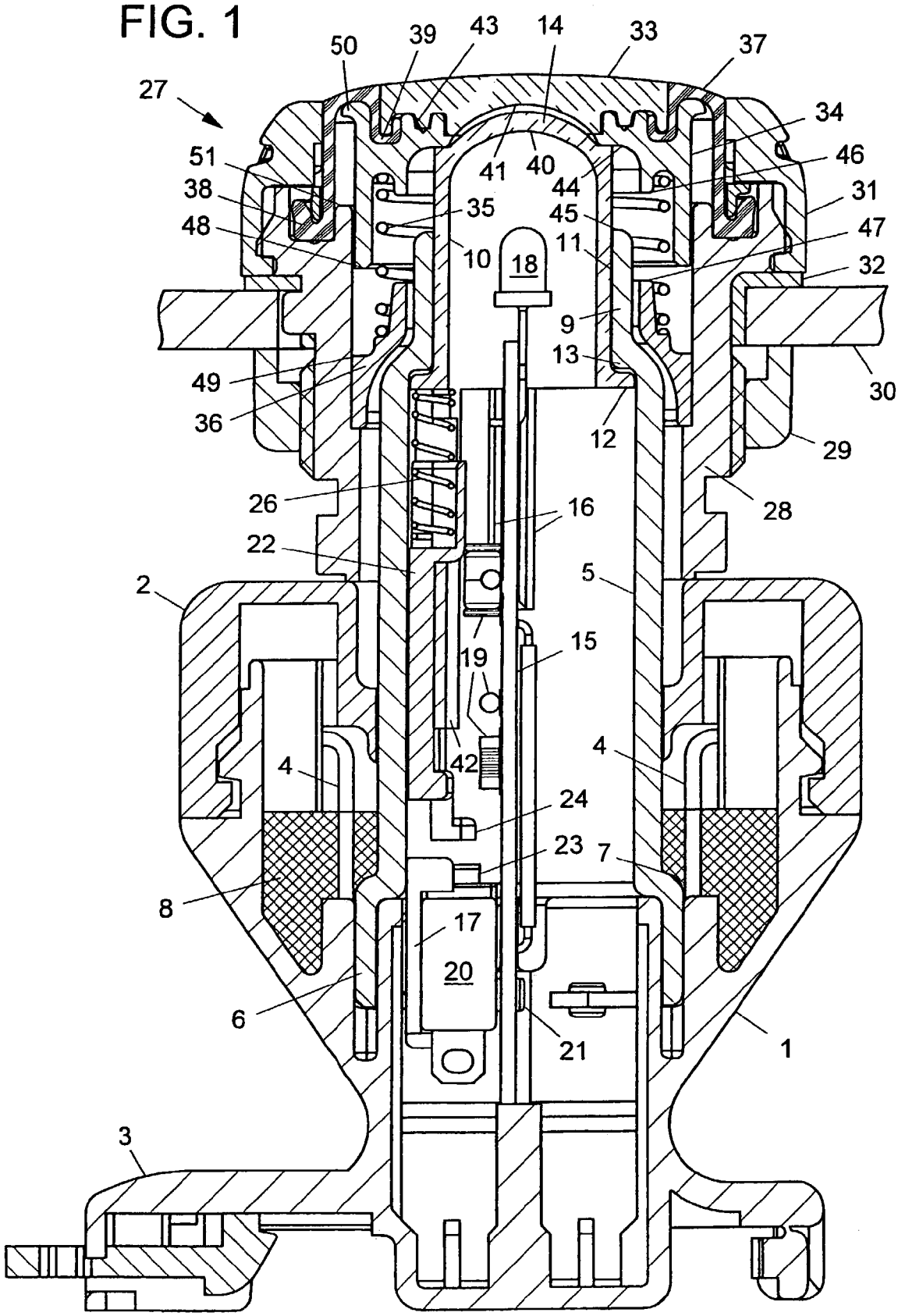
Figure 2:
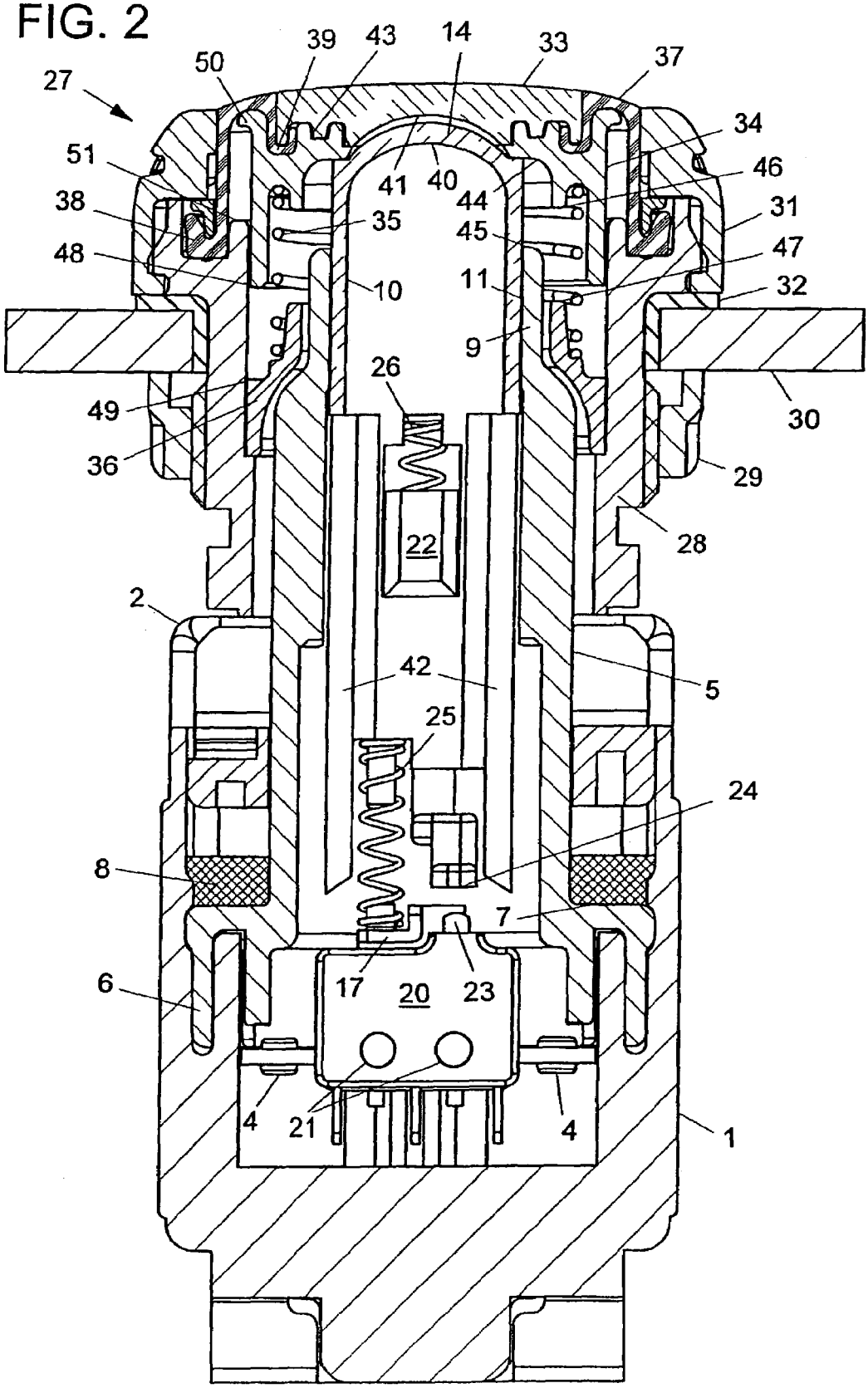
Figure 3:
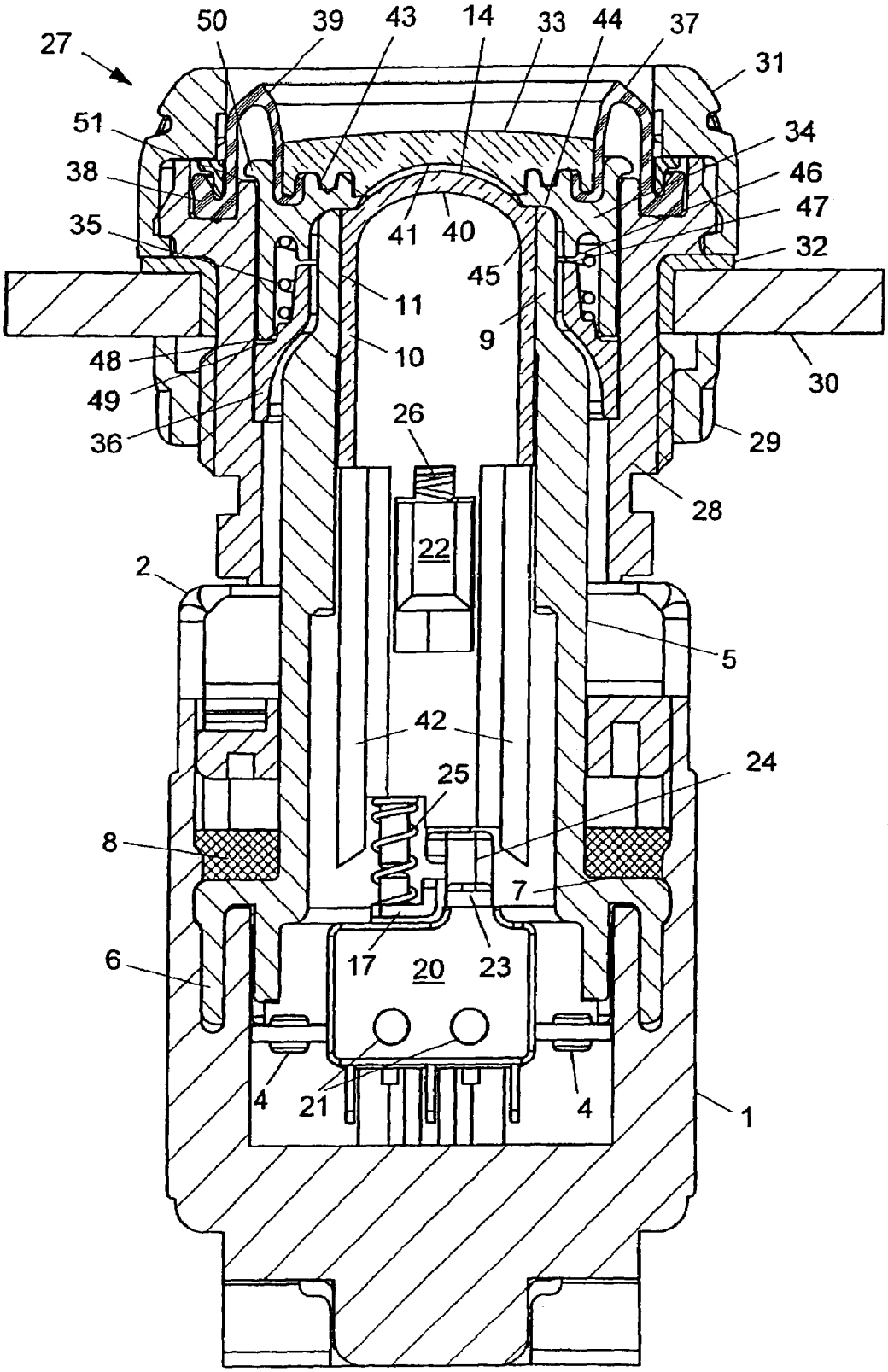

Further advantages and major details of the invention can be derived from the following Description and the drawings, which in a diagrammatic representation show preferred embodiments by way of examples. These show:

FIG. 1 A indicating light according to the invention in an enlarged plan view, partially sectioned, FIG. 2 The indicating light from FIG. 1 in a plan view rotated through 90°, partially sectioned, and FIG. 3 The indicating light from FIG. 2 with a push element depressed axially.

The indicating light exhibits a housing 1 with a cover 2 and a foot piece 3, which is capable of being secured to a profile rail, not shown here. Located in the housing are electrically conductive parts 4 for the connection of electrical infeed and outfeed lines and connection terminals, likewise not represented.

Located in the housing 1 is also a hollow rod 5, which is designed essentially as a rod which is cylindrically circular in cross-section, which passes through the cover 2 and has a rectangular shaped rod end piece 6 at the bottom, which is secured in a housing 1 and of which the rectangular dimensions are somewhat greater than the diameter of the adjacent part of the hollow rod 5. At the beginning of the rod end part 6, a shoulder 7 is formed because of the greater rectangular dimension. In this area the hollow rod 5 is surrounded by a casting of artificial resin 8 introduced into the housing 1, this casting engaging around the shoulder 7. The cast resin casting 8 is designed in such a way that it accords with the standardised requirements of explosion protection according to German Industrial Standard (Deutsche Industrienorm) DIN 50014/18/19 and European Standard EN 500 14/18/19.

The end area 9 of the hollow rod 5 located away from the rod end piece 6 has a diameter which is somewhat smaller than the middle section of the hollow rod 5. Mounted in the end area 9 is an axially displaceable push element 10, arranged in such a way that between the inner surface of the end section 9 and the outer surface of the push element 10 a standardised explosion protection gap 11 is formed in accordance with German Industrial Standard (Deutsche Industrienorm) DIN 50014/18 and European Standard EN 50014/18.

The push element 10 exhibits lugs 12, which come in contact with a stop 13 formed by the cross-section narrowing of the end area 9. On the side located away from the lugs 12 the push element 10 is enclosed by a hemispherically-shaped translucent round head 14. The push element 10 can to the purpose be manufactured of uniform material and as one piece with the lugs 12 and the translucent round head 14, made of a translucent material. For use in areas subject to the risk of explosion, the hollow rod 5, with the push element 10 and the housing 1, can be designed as a pressure-resistant capsule in accordance with the requirements of explosion protection.

A printed circuit board 15 can be mounted in the hollow rod 5, which for preference is fixed between web-shaped retaining ribs 16 and a mounting bracket 17. The printed circuit board 15 carries a light-emitting diode 18, which is located at the level of the end area 9 inside the push element 10 at a distance interval beneath the translucent round bead 14 and is aligned towards this. In addition, electronic components 19 serving the function of the light-emitting diode 16 can be arranged on the printed circuit board 15.

In addition to this, an electric switch 20 can be arranged in the hollow rod 5 in the area of the rod end part 6, which is likewise mounted on the mounting bracket 17. For preference the mounting bracket 17 can also exhibit two gudgeons 21, which engage in corresponding holes of the switch 20 and the printed circuit board 15. The mounting bracket 17 itself can likewise be positioned in the hollow rod 5 and fixed in position by means of the electrical conductor parts 4.

In order to be able to actuate the switch 20 when the push element 10 is pushed in, a contact element 22 is provided inside the hollow rod 5 between the push element 10 and the switch 20, which can be displaced in the longitudinal direction of the hollow rod 5 against a tappet 23 of the switch 20. The switch element 22 can be mounted on guide rails 42 and be provided with a switch bolt 24, which corresponds to the tappet 23. To the purpose, a pressure spring 25 is allocated to the switch element 22, which is supported inside the hollow rod 5 on the mounting bracket 17, and has the effect that the switch element 23 and the push element 10 located above it are pushed upwards, i.e. away from the tappet 23. In addition to this, an over-stroke spring 26 is provided, which is arranged between the push element 10 and the switch element 22. Accordingly, all electrical technically relevant light and switching components, such as the light-emitting diode 18, printed circuit board 15, components 19, switch element 22, pressure spring 25, over-stroke spring 25 and switch 20, are arranged in a space-saving arrangement behind one another and in part also next to one another, mounted exclusively inside the pressure-resistant encapsulated area of the tubular hollow rod 5.

As can also be derived from the drawing, the indicating light can exhibit an operating attachment 27, which engages over the part of the hollow rod 6 projecting out of the cover 2 and the pressure element 10. The actuating attachment 27 exhibits an insertion housing 28 surrounding the hollow rod 5 in tubular fashion, with a threaded nut 29, and can be secured to a mounting wall 30, which is mounted between the threaded nut 29 and a front ring 31, whereby a sealing ring 32 can be provided between the perforated edge of the mounting wall 30 and the insertion housing 28, as well as the front ring 31. The threaded nut 29 rotatably mounted on the insertion housing 28 is in this situation screwed against the inner side of the mounting wall 30, so that the actuating attachment 27 is mounted in a locationally-secure manner.

In addition to this, the actuating attachment 27 exhibits a translucent light cap 33, which engages over the light cap 14 of the push element 10. The light cap 33 is part of an adaptor sleeve 34, which in turn is part of the push element 10, so that, in the event of a switch actuation, both the push element 10 and the light cap 33 with the adaptor sleeve are displaced axially. The adaptor sleeve 34 is supported by a support spring 35 designed as a pressure spring, which is supported on a sleeve 36. In order to achieve a tight seal upwards at the actuating attachment 27, a moulded seal 37 can be provided, which is mounted with a seat 36 in a groove of the insertion housing 28, and is retained by means of the front ring 31. As can be seen from the drawing, the peripheral areas of the light cap 33 and the adaptor sleeve 34 are engaged and sealed by a collar 39 of the moulded seal 37, whereby the sealed system pertains at the collar 39 after the connection of the tongue-and-groove segment 43. This connection can, to the purpose, be created by adhesive bonding or by ultrasonic welding.

In the printed circuit board (FIG. 3) the push element 10 with the light cap 33 and the adaptor sleeve 34 is pressed against the force of the support spring 35 axially downwards, and specifically sufficiently far for a contact surface 44 of the adaptor sleeve 34 to come in contact with the face surface 45 of the end area 9 of the hollow rod 5, so that a secure support arrangement is provided, in that a downwards-pointing peripheral surface 46 of the adaptor sleeve 34 is in contact with an upwards-pointing annular surface 47 of the sleeve 36, a downwards-pointing end surface 48 of the adaptor sleeve 34 lies on a circular surface 49 of the sleeve 36, and a lug 50 of the adaptor sleeve 34 comes in contact with an upwards-pointing web surface 51 of the insertion housing 28. As a result of this, a four-fold support is provided at push actuation, so that even high impact forces can be reliably absorbed and no mechanical damage can be incurred.

In the pressed switch position, the switch element 22 is displaced against the force of the pressure spring 25 so far downwards that the tappet 23 is pressed right inwards by the switch bolt 24 in order to actuate the switch 20. In addition, it can be seen from FIG. 3 that the over-stroke spring 25 is also compressed somewhat in relation to the representation in FOG. 2, so that no rigid forces take effect on the switch 20, and this therefore also cannot be damaged.

In order to achieve a uniform and bright illumination, it may be of advantage for at least the hemispherical inner surface 40 of the light cap. 14 of the push element 10, turned towards the light-emitting diode 18, to be designed in such a way that a fine-beaded structure is exhibited. The inside surface 40 can therefore have a plurality of small spherical or bead-shaped elevations and a plurality of small depressions, arranged alternately directly next to one another, so that the inside surface 40 is not smooth but finely roughened. Such a finely roughened inside surface structure can to advantage be produced by erosion, etching, shot-blasting, or by a corresponding arrangement of the mould surface. The finely-roughened inside surface structure has the effect that the light emitted by the light-emitting diode 16 breaks and is caught on the entire inside surface 40 of the light cap 14 in such a way a uniformly great lighting body lights up. In addition to this, it is also of advantage for the pressure element 10 overall, but at least the light cap 14, to be coloured in a diffuse milky or milk-coloured fluorescent manner. By way of such a colouration, the light permeability is reduced in such a manner that, with the light-emitting diode 18 switched on, a certain inherent lighting of the pressure element 10 and of the light cap 14 respectively occurs, as a result of which the lighting effect is even more uniform and intensive.

Like the light cap 14, the light cap 33 also consists of a translucent material and covers the light cap 14 at a brief distance interval. The inner side 41 of the light cap 33 turned towards the light cap 14 can likewise have a fine-beaded structure. This structure can be designed in such a way that a plurality of small bead-shaped elevations and a plurality of small depressions are located alternating directly next to one another, so that the inside surface 41 is finely roughed. This finely-roughed inside surface structure can essentially be designed in the same way as the finely-roughed inside surface structure of the light cap 14, and manufactured in accordance with the same production process. In addition to this, it can also be of advantage for the light cap 33 to be coloured in a diffuse milky fashion or in a milky fluorescent manner, in order for the light permeability to be reduced, as a result of which an inherent lighting of the light cap 33 and a uniform and more intensive lighting is achieved. An optimally bright and uniform lighting can also be achieved in that both the light cap 14 of the pressure element 10, as well as the light cap 33 of the actuating attachment 27, are coloured in accordance with the light or colour wavelength of the light-emitting diode 18.

The invention claimed is:

1. Indicating light for optical display, comprising a housing (1) with electrical conductor parts (4) and a foot piece (3), a light-emitting diode (18) in a push element (10) which has a translucent round head (14), a hollow rod (5) with a first end area (9) on which the push element (10) is axially moveably located and wherein a second end area (6) of the hollow rod (5) is arranged in the housing (1), and an electrical switch (20) which is arranged in the hollow rod (5), in its longitudinal direction behind the light-emitting diode (18), and is operable by axial movement of the push element 10;

wherein a contact element (22) disposed behind the light emitting diode (18) can be moved against a tappet (23) of the switch (20) and is arranged between the push element (10) and the electrical switch (20).

2. Indicating light for optical display, comprising a housing (1) with electrical conductor parts (4) and a foot piece (3), a light-emitting diode (18) in a push element (10) which has a translucent round head (14), a hollow rod (5) with a first end area (9) on which the push element (10) is axially moveably located and wherein a second end area (6) of the hollow rod (5) is arranged in the housing (1), and an electrical switch (20) which is arranged in the hollow rod (5), in its longitudinal direction behind the light-emitting diode (18), and is operable by axial movement of the push element (10);

wherein a contact element (22) and the push element (10) are supported at a thrust spring (25) positioned in the housing (1).

3. Indicating light for optical display, comprising a housing (1) with electrical conductor parts (4) and a foot piece (3), a light-emitting diode (18) in a push element (10) which has a translucent round head (14), a hollow rod (5) with a first end area (9) on which the push element (10) is axially moveably located and wherein a second end area (6) of the hollow rod (5) is arranged in the housing (1), and an electrical switch (20) which is arranged in the hollow rod (5), in its longitudinal direction behind the light-emitting diode (18), and is operable by axial movement of the push element (10);

wherein an over run spring (26) is provided between the push element (10) and a contact element (22).

4. Indicating light for optical display, comprising a housing (1) with electrical conductor parts (4) and a foot piece (3), a light-emitting diode (18) in a push element (10) which has a translucent round head (14), a hollow rod (5) with a first end area (9) on which the push element (10) is axially moveably located and wherein a second end area (6) of the hollow rod (5) is arranged in the housing (1), and an electrical switch (20) which is arranged in the hollow rod (5), in its longitudinal direction behind the light-emitting diode (18), and is operable by axial movement of the push element (10);

wherein the push element (10) is supported by lugs (12) at a stop (13) in the hollow rod (5).

5. Indicating light according to claim 4, characterised in that part of the hollow rod (5) is cast over in the housing (1) with moulding resin (8).

6. Indicating light according to claim 4, characterised in that an explosion protection gap (11) is formed between the inner face of the hollow rod (5) and an outer face of the push element (10) axially movable in the latter.

7. Indicating light according to claim 4, characterised in that the hollow rod (5) with the push element (10) and the housing (1) is designed as a pressure-tight capsule.

8. Indicating light according to claim 4, characterised in that the housing (1) is closed by a cover (2) into which the hollow rod (5) protrudes.

9. Indicating light according to claim 4 characterised in that a printed circuit board (15) with the light-emitting diode (18), the electric switch (20) and electronic components (19) arranged on it is provided within the hollow rod (5).

10. Indicating light according to claim 4 characterised in that the electrical switch (20) is positioned at a mounting bracket (17).

11. Indicating light according to claim 4 characterised in that a mounting bracket (17) has at least one pin (21) passing through the switch (20) and engaging the printed circuit board (15).

12. Indicating light for optical display, comprising a housing (1) with electrical conductor parts (4) and a foot piece (3), a light-emitting diode (18) in a push element (10) which has a translucent round head (14), a hollow rod (5) with a first end area (9) on which the push element (10) is axially moveably located and wherein a second end area (6) of the hollow rod (5) is arranged in the housing (1), and an electrical switch (20) which is arranged in the hollow rod (5), in its longitudinal direction behind the light-emitting diode (18), and is operable by axial movement of the push element (10);

wherein mounting bracket (17) is positioned in the hollow rod (5) and fixed in position by means of the conductor parts (4).

13. Indicating light for optical display, comprising a housing (1) with electrical conductor parts (4) and a foot piece (3), a light-emitting diode (18) in a push element (10) which has a translucent round head (14), a hollow rod (5) with a first end area (9) on which the push element (10) is axially moveably located and wherein a second end area (6) of the hollow rod (5) is arranged in the housing (1), and an electrical switch (20) which is arranged in the hollow rod (5), in its longitudinal direction behind the light-emitting diode (18), and is operable by axial movement of the push element (10);

wherein an operating attachment (27) extends over the part of the hollow rod (5) which protrudes past a cover (2) of the housing (1).

14. Indicating light for optical display, comprising a housing (1) with electrical conductor parts (4) and a foot piece (3), a light-emitting diode (18) in a push element (10) which has a translucent round head (14), a hollow rod (5) with a first end area (9) on which the push element (10) is axially moveably located and wherein a second end area (6) of the hollow rod (5) is arranged in the housing (1), and an electrical switch (20) which is arranged in the hollow rod (5), in its longitudinal direction behind the light-emitting diode (18), and is operable by axial movement of the push element (10);

wherein an operating attachment (27) is attachable to a mounting wall (30) which is arranged between a front ring (31) and a threaded nut (29) located at an insert housing (28).

15. Indicating light for optical display, comprising a housing (1) with electrical conductor parts (4) and a foot piece (3), a light-emitting diode (18) in a push element (10) which has a translucent round head (14), a hollow rod (5) with a first end area (9) on which the push element (10) is axially moveably located and wherein a second end area (6) of the hollow rod (5) is arranged in the housing (1), and an electrical switch (20) which is arranged in the hollow rod (5), in its longitudinal direction behind the light-emitting diode (18), and is operable by axial movement of the push element (10);

wherein an operating attachment (27) has a translucent light cap (33) extending over the round head (14) of the push element (10).

16. Indicating light for optical display, comprising a housing (1) with electrical conductor parts (4) and a foot piece (3), a light-emitting diode (18) in a push element (10) which has a translucent round head (14), a hollow rod (5) with a first end area (9) on which the push element (10) is axially moveably located and wherein a second end area (6) of the hollow rod (5) is arranged in the housing (1), and an electrical switch (20) which is arranged in the hollow rod (5), in its longitudinal direction behind the light-emitting diode (18), and is operable by axial movement of the push element (10);

wherein a light cap (33) is arranged at an adaptor sleeve (34) which is associated with the push element (10) and axially movable with it.

17. Indicating light according to claim 16, characterised in that an inner side (40) of the round head (14) of the push element (10) facing the light-emitting diode (18) has a refractive fine pearl structure.

18. Indicating light according to claim 16, characterized in that at least the round head (14) of the push element (10) has a milky tint.

19. Indicating light according to claim 16, characterised in that at least the round head (14) of the push element (10) has a milky/coloured fluorescent tint.

20. Indicating light according to claim 16, characterised in that the push element (10) is formed in one piece with the round head (14) and is made from the same material.

21. Indicating light according to claim 16, characterised in that an inner side (41) of a light cap (33) facing the round head (14) of the push element (10) has a refracting fine pearl structure.

22. Indicating light according to claim 16, characterised in that a fine pearl structure of an inner side (40) of the round head (14) and a fine pearl structure of an inner side (41) of a light cap (33) are essentially identical.

23. The indicating light according to claim 22 further comprising an actuating attachment (27) disposed in front of the translucent round head (14), wherein the actuating attachment (27) is mounted in a locationally-secure manner by means of a threaded nut (29) rotatably mounted on an insertion housing (28) screwed against an inner side of a mounting wall (30);

a translucent light cap (33) disposed in front of the translucent round head (14), wherein the translucent light cap (33) is part of an adaptor sleeve (34), which in turn is part of the push element (10), such that, in the event of a switch actuation, both the push element (10) and the translucent light cap (33) with the adaptor sleeve (34) are displaced axially and wherein the adaptor sleeve (34) is supported by a support spring (35) constructed as a pressure spring, which is supported on a sleeve (36).

24. The indicating light according to claim 23 further comprising a collar (39) of a molded seal (37), wherein the adaptor sleeve (34) is engaged and sealed by a collar (39) of the moulded seal (37), wherein a sealed system remains at the collar (39) after a connection of a tongue-and-groove segment (43) and wherein the connection of the tongue-and-groove segment (43) created by an adhesive bonding or by an ultrasonic welding.

25. Indicating light according to claim 16, characterised in that the round head (14) of the push element (10) and a light cap (33) are tinted to suit the wavelength of the light-emitting diode (18).

26. Indicating light according to claim 16, characterised in that a printed circuit board (15) is positioned at a mounting bracket (17), wherein the mounting bracket (17) exhibit two gudgeons (21), which engage in corresponding holes of the switch (20) and the printed circuit board (15).

27. Indicating light for optical display, comprising a housing (1) with electrical conductor parts (4) and a foot piece (3), a light-emitting diode (18) in a push element (10) which has a translucent round head (14), a hollow rod (5) with a first end area (9) on which the push element (10) is axially moveably located and wherein a second end area (6) of the hollow rod (5) is arranged in the housing (1), and an electrical switch (20) which is arranged in the hollow rod (5), in its longitudinal direction behind the light-emitting diode (18), and is operable by axial movement of the push element (10);

wherein an adaptor sleeve (34) has an associated supporting spring (35) which is supported at a seat (36).

28. Indicating light for optical display, comprising a housing (1) with electrical conductor parts (4) and a foot piece (3), a light-emitting diode (18) in a push element (10) which has a translucent round head (14), a hollow rod (5) with a first end area (9) on which the push element (10) is axially moveably located and wherein a second end area (6) of the hollow rod (5) is arranged in the housing (1), and an electrical switch (20) which is arranged in the hollow rod (5), in its longitudinal direction behind the light-emitting diode (18), and is operable by axial movement of the push element (10);

wherein an adaptor sleeve (34) and a light cap (33) rest at a moulded seal (37) when the push element (10) is at rest.

29. Indicating light for optical display, comprising a housing (1) with electrical conductor parts (4) and a foot piece (3), a light-emitting diode (18) in a push element (10) which has a translucent round head (14), a hollow rod (5) with a first end area (9) on which the push element (10) is axially moveably located and wherein a second end area (6) of the hollow rod (5) is arranged in the housing (1), and an electrical switch (20) which is arranged in the hollow rod (5), in its longitudinal direction behind the light-emitting diode (18), and is operable by axial movement of the push element (10);

wherein an adaptor sleeve (34) has at least one stop face (44) corresponding to an end face (45) of an end section (9) of the hollow rod (5) for limiting a push element (10) operating stroke.

30. Indicating light for optical display, comprising a housing (1) with electrical conductor parts (4) and a foot piece (3), a light-emitting diode (18) in a push element (10) which has a translucent round head (14), a hollow rod (5) with a first end area (9) on which the push element (10) is axially moveably located and wherein a second end area (6) of the hollow rod (5) is arranged in the housing (1), and an electrical switch (20) which is arranged in the hollow rod (5), in its longitudinal direction behind the light-emitting diode (18), and is operable by axial movement of the push element (10);

wherein a multiple support with an additional edge face (46), an annular face (47), an end face (48), a shoulder face (49), a stay face (51) and a lug (50) is provided for limiting a push element (10) operating stroke.

31. Indicating light for optical display, comprising a housing (1) with electrical conductor parts (4) and a foot piece (3), a light-emitting diode (18) in a push element (10) which has a translucent round head (14), a hollow rod (5) with a first end area (9) on which the push element (10) is axially moveably located and wherein a second end area (6) of the hollow rod (5) is arranged in the housing (1), and an electrical switch (20) which is arranged in the hollow rod (5), in its longitudinal direction behind the light-emitting diode (18), and is operable by axial movement of the push element (10);

wherein a moulded seal (37) is held at an insert housing (28) by means of a front ring (31).

32. An indicating light for an optical display comprising a housing (1);

a hollow rod (5) having a first end area (9) and having a second end area with a rod end piece (6), wherein the rod end piece (6) is fitted into the housing (1);

a push element (10) having a translucent round head (14) and surrounded by the first end area (9) of the hollow rod (5) and disposed movable in an axial direction relative to the hollow rod (5);

a light-emitting diode (18) disposed in the push element (10) and surrounded by the first end area of the hollow rod (5);

an electrical switch (20) disposed in the hollow rod (5) in a longitudinal direction of the hollow rod (5) behind the light-emiffing diode (18), and operable by axial movement of the push element (10);

a contact element (22) associated with the push element (10) is movable against a tappet (23) of the switch (20) and is arranged between the push element (10) and the electrical switch (20).

33. The indicating light according to claim 32 further comprising a moulding resin, wherein a part of the hollow rod (5) is cast over in the housing (1) with the moulding resin (8) according to explosion protection requirements.

34. The indicating light according to claim 32 further comprising an explosion protection gap (11) conforming to European standard EN 50014/18 is formed between an inner face of the hollow rod (5) and an outer face of the push element (10), wherein the push element (10) is axially movable in the hollow rod (5).

35. The indicating light according to claim 32 wherein the hollow rod (5) together with the push element (10) and the housing (1) is designed as a pressure-tight capsule conforming to European standard EN 50014/18/19 relating to explosion protection.

36. The indicating light according to claim 32 further comprising a printed circuit board (15) supporting the light-emitting diode (18) is disposed within the hollow rod (5);

electronic components (19) arranged on the printed circuit board (15).

37. An indicating light for an optical display comprising a housing (1);

a hollow rod (5) having a first end area (9) and having a second end area with a rod end piece (6), wherein the rod end piece (6) is fitted into the housing (1);

a push element (10) having a translucent round head (14) and surrounded by the first end area (9) of the hollow rod (5) and disposed movable in an axial direction relative to the hollow rod (5);

a light-emitting diode (18) disposed in the push element (10) and surrounded by the first end area of the hollow rod (5);

an electrical switch (20) disposed in the hollow rod (5) in a longitudinal direction of the hollow rod (5) behind the light-emitting diode (18), and operable by axial movement of the push element (10);

a thrust spring (25) positioned in the housing (1);

a contact element (22) associated with the push element (10) and the push element (10) are supported at the thrust spring (25).

38. The indicating light according to claim 37 further comprising an over run spring (26) furnished between the push element (10) and the contact element (22).

39. An indicating light for an optical display comprising a housing (1);

a hollow rod (5) having a first end area (9) and having a second end area with a rod end piece (6), wherein the rod end piece (6) is fitted into the housing (1);

a push element (10) having a translucent round head (14) and surrounded by the first end area (9) of the hollow rod (5) and disposed movable in an axial direction relative to the hollow rod (5);

a light-emitting diode (18) disposed in the push element (10) and surrounded by the first end area of the hollow rod (5);

an electrical switch (20) disposed in the hollow rod (5) in a longitudinal direction of the hollow rod (5) behind the light-emitting diode (18), and operable by axial movement of the push element (10);

lugs (12), wherein the push element (10) is supported by the lugs (12) at a stop (13) in the hollow rod (5).

40. An indicating light for an optical display comprising a housing (1);

a hollow rod (5) having a first end area (9) and having a second end area with a rod end piece (6), wherein the rod end piece (6) is fitted into the housing (1);

a push element (10) having a translucent round head (14) and surrounded by the first end area (9) of the hollow rod (5) and disposed movable in an axial direction relative to the hollow rod (5);

a light-emitting diode (18) disposed in the push element (10) and surrounded by the first end area of the hollow rod (5);

an electrical switch (20) disposed in the hollow rod (5) in a longitudinal direction of the hollow rod (5) behind the light-emitting diode (18), and operable by axial movement of the push element (10);

a cover (2), wherein the housing (1) is closed by the cover (2) and wherein the hollow rod (5) protrudes into the cover (2).

41. The indicating light according to claim 40 further comprising conductor parts (4) disposed in the hollow rod (5);

a mounting bracket (17) positioned in the hollow rod (5) and fixed in position by means of the conductor parts (4).

42. The indicating light according to claim 40 further comprising, an operating attachment (27) extending over a part of the hollow rod (5), which part of the hollow rod (5) protrudes past the cover (2) of the housing (1).

43. The indicating light according to claim 40, wherein an inner side (40) of the translucent round head (14) of the push element (10) facing the light-emitting diode (18) has a refractive fine pearl structure.

44. The indicating light according to claim 40, wherein at least the round head (14) of the push element (10) has a milky tint or a milky/coloured fluorescent tint.

45. The indicating light according to claim 40, wherein the push element (10) is formed in one piece with the translucent round head (14) and wherein the push element (10) and the translucent round head (14) are made of the same material.

46. The indicating light according to claim 40 further comprising a light cap (33) disposed in front of the translucent round head (14), wherein an inner side (41) of the light cap (33) facing the translucent round head (14) of the push element (10) has a refracting fine pearl structure.

47. The indicating light according to claim 46 wherein a fine pearl structure of an inner side (40) of the translucent round head (14) and the fine pearl structure of the inner side (41) of the light cap (33) are essentially of identical structure.

48. The indicating light according to claim 40 further comprising a light cap (33) disposed in front of the translucent round head (14), wherein the round head (14) of the push element (10) and the light cap (33) are tinted in a color to allow passage of the wavelength of the light-emitting diode (18).

49. The indicating light according to claim 40, wherein the printed circuit board (15) carries the light-emitting diode (18) and wherein the light-emitting diode (18) is located at the level of the first end area (9) of the push element (10) and is disposed at a distance interval beneath the translucent round head (14) and is aligned towards the translucent round head (14).

50. An indicating light for an optical display comprising a housing (1);

a hollow rod (5) having a first end area (9) and having a second end area with a rod end piece (6), wherein the rod end piece (6) is fitted into the housing (1);

a push element (10) having a translucent round head (14) and surrounded by the first end area (9) of the hollow rod (5) and disposed movable in an axial direction relative to the hollow rod (5);

a light-emitting diode (18) disposed in the push element (10) and surrounded by the first end area of the hollow rod (5);

an electrical switch (20) disposed in the hollow rod (5) in a longitudinal direction of the hollow rod (5) behind the light-emitting diode (18), and operable by axial movement of the push element (10);

an insert housing (28) surrounding the first end area (9) of the hollow rod (5);

a front ring (31) located at the insert housing (28);

a threaded nut (29) located at the insert housing (28);

a mounting wall (30) which is arranged between the front ring (31) and the threaded nut (29);

an operating attachment (27) attachable to a mounting wall (30).

51. An indicating light for an optical display comprising a housing (1);

a hollow rod (5) having a first end area (9) and having a second end area with a rod end piece (6), wherein the rod end piece (6) is fitted into the housing (1);

a push element (10) having a translucent round head (14) and surrounded by the first end area (9) of the hollow rod (5) and disposed movable in an axial direction relative to the hollow rod (5);

a light-emitting diode (18) disposed in the push element (10) and surrounded by the first end area of the hollow rod (5);

an electrical switch (20) disposed in the hollow rod (5) in a longitudinal direction of the hollow rod (5) behind the light-emitting diode (18), and operable by axial movement of the push element (10);

an operating attachment (27) having a translucent light cap (33) extending over the translucent round head (14) of the push element (10).

52. An indicating light for an optical display comprising a housing (1);

a hollow rod (5) having a first end area (9) and having a second end area with a rod end piece (6), wherein the rod end piece (6) is fitted into the housing (1);

a push element (10) having a translucent round head (14) and surrounded by the first end area (9) of the hollow rod (5) and disposed movable in an axial direction relative to the hollow rod (5);

a light-emitting diode (18) disposed in the push element (10) and surrounded by the first end area of the hollow rod (5);

an electrical switch (20) disposed in the hollow rod (5) in a longitudinal direction of the hollow rod (5) behind the light-emitting diode (18), and operable by axial movement of the push element (10);

an adaptor sleeve (34) associated with the push element (10) and axially movable with the push element (10);

a light cap (33) arranged at the adaptor sleeve (34).

53. The indicating light ;according to claim 52 further comprising a seat (36) surrounding the hollow rod (5);

a supporting spring (35) associated with the adaptor sleeve (34), wherein the supporting spring (35) is supported at a seat (36).

54. The indicating light according to claim 52 further comprising a molded seal (37) surrounding the push element (10), wherein the adaptor sleeve (34) and the light cap (33) rest at the moulded seal (37) while the push element (10) is at rest.

55. The indicating light according to claim 52 further comprising a stop face (44) formed at the adaptor sleeve (34), wherein the stop face (44) corresponds to an end face (45) of the first end area (9) of the hollow rod (5) for limiting a push element (10) operating stroke.

56. An indicating light for an optical display comprising a housing (1);

a hollow rod (5) having a first end area (9) and having a second end area with a rod end piece (6), wherein the rod end piece (6) is fitted into the housing (1);

a push element (10) having a translucent round head (14) and surrounded by the first end area (9) of the hollow rod (5) and disposed movable in an axial direction relative to the hollow rod (5);

a light-emitting diode (18) disposed in the push element (10) and surrounded by the first end area of the hollow rod (5);

an electrical switch (20) disposed in the hollow rod (5) in a longitudinal direction of the hollow rod (5) behind the light-emitting diode (18), and operable by axial movement of the push element (10);

a multiple support with an additional edge face (46), an annular face (47), an end face (48), a shoulder face (49), a stay face (51) and a lug (50) is provided for limiting a push element (10) operating stroke.

57. An indicating light for an optical display comprising a housing (1);

a hollow rod (5) having a first end area (9) and having a second end area with a rod end piece (6), wherein the rod end piece (6) is fitted into the housing (1);

a push element (10) having a translucent round head (14) and surrounded by the first end area (9) of the hollow rod (5) and disposed movable in an axial direction relative to the hollow rod (5);

a light-emitting diode (18) disposed in the push element (10) and surrounded by the first end area of the hollow rod (5);

an electrical switch (20) disposed in the hollow rod (5) in a longitudinal direction of the hollow rod (5) behind the light-emitting diode (18), and operable by axial movement of the push element (10);

an insert housing (28) surrounding the hollow rod (5) in tubular fashion;

a molded seal (37) seated in the insert housing (28);

a front ring (31) holding the moulded seal (37) is held at the insert housing (28).

58. An indicating light for an optical display comprising a housing (1);

a hollow rod (5) having a first end area (9) and having a second end area with a rod end piece (6), wherein the rod end piece (6) is fitted into the housing (1);

a push element (10) having a translucent round head (14) and surrounded by the first end area (9) of the hollow rod (5) and disposed movable in an axial direction relative to the hollow rod (5);

a light-emitting diode (18) disposed in the push element (10) and surrounded by the first end area of the hollow rod (5);

an electrical switch (20) disposed in the hollow rod (5) in a longitudinal direction of the hollow rod (5) behind the light-emitting diode (18), and operable by axial movement of the push element (10);

a mounting bracket (17) disposed in the hollow rod (5), wherein the mounting bracket (17) exhibits two gudgeons (21), which engage in corresponding holes of the switch (20) and of a printed circuit board (15), a contact element (22), wherein the contact element (22) is mounted on guide rails (42) and has a switch bolt (24) which corresponds to a tappet (23) of the switch (20).

59. An indicating light for an optical display comprising a housing (1);

a hollow rod (5) having a first end area (9) and having a second end area with a rod end piece (6), wherein the rod end piece (6) is fitted into the housing (1);

a push element (10) having a translucent round head (14) and surrounded by the first end area (9) of the hollow rod (5) and disposed movable in an axial direction relative to the hollow rod (5);

a light-emitting diode (18) disposed in the push element (10) and surrounded by the first end area of the hollow rod (5);

an electrical switch (20) disposed in the hollow rod (5) in a longitudinal direction of the hollow rod (5) behind the light-emitting diode (18), and operable by axial movement of the push element (10);

wherein the hollow rod (5) is tubular and wherein the light-emitting diode (18), a printed circuit board (15), electronic components (19), a contact element (22), a pressure spring (25), an over-stroke spring (26) and the switch (20) are arranged exclusively inside the pressure-resistant encapsulated area of the tubular hollow rod (5).

60. An indicating light for an optical display comprising a housing (1);

a hollow rod (5) having a first end area (9) and having a second end area with a rod end piece (6), wherein the rod end piece (6) is fitted into the housing (1);

a push element (10) having a translucent round head (14) and surrounded by the first end area (9) of the hollow rod (5) and disposed movable in an axial direction relative to the hollow rod (5);

a light-emitting diode (18) disposed in the push element (10) and surrounded by the first end area of the hollow rod (5);

an electrical switch (20) disposed in the hollow rod (5) in a longitudinal direction of the hollow rod (5) behind the light-emitting diode (18), and operable by axial movement of the push element (10);

a translucent light cap (33) disposed in front of the translucent round head (14), wherein the push element (10) with the translucent light cap (33) and an adaptor sleeve (34) is pressed against the force of the support spring (35) axially downwards and specifically sufficiently far such that a contact surface (44) of the adaptor sleeve (34) to come in contact with a face surface (45) o; the hollow rod (5), wherein a downwards-pointing peripheral surface (46) of the adaptor sleeve (34) is in contact with an upwards-pointing annular surface (47) of the sleeve (36); and wherein a downwards-pointing end surface (48) of the adaptor sleeve (34) lies on a circular surface (49) of the sleeve (36), and wherein a lug (50) of the adaptor sleeve (34) comes in contact with an upwards-pointing web surface (51) of an insertion housing (28).

61. An indicating light for an optical display comprising a housing (1);

a hollow rod (5) having a first end area (9) and having a second end area with a rod end piece (6), wherein the rod end piece (6) is fitted into the housing (1);

a push element (10) having a translucent round head (14) and surrounded by the first end area (9) of the hollow rod (5) and disposed movable in an axial direction relative to the hollow rod (5);

a light-emitting diode (18) disposed in the push element (10) and surrounded by the first end area of the hollow rod (5);

an electrical switch (20) disposed in the hollow rod (5) in a longitudinal direction of the hollow rod (5) behind the light-emitting diode (18), and operable by axial movement of the push element (10);

a mounting bracket (17) disposed in the hollow rod (5);

a printed circuit board(15) disposed in the hollow rod (5), wherein the switch (20) and the printed circuit board (15) are positioned at the mounting bracket (17).

62. The indicating light according to claim 61 further comprising at least one pin (21) formed at the mounting bracket (17), wherein the at least one pin (21) passes through the switch (20) and engages the printed circuit board (15).

* * * * *